United States Patent [19]

Aden

[11] 4,343,516

[45] Aug. 10, 1982

[54] CUTTER BIT ASSEMBLY

[75] Inventor: Michael L. Aden, Indiana, Pa.

[73] Assignee: Ingersoll-Rand Company, Woodcliff Lakes, N.J.

[21] Appl. No.: 176,986

[22] Filed: Aug. 11, 1980

[51] Int. Cl.[3] ..... E21C 35/18

[52] U.S. Cl. ..... 299/86; 299/91; 407/46

[58] Field of Search ..... 299/86, 91, 92, 93; 175/413; 407/46, 47, 101, 102, 120

[56] References Cited

U.S. PATENT DOCUMENTS

| | | | |
|---|---|---|---|
| 2,434,256 | 1/1948 | Bowman | 299/91 |
| 3,697,137 | 10/1972 | Krekeler | 299/86 |

FOREIGN PATENT DOCUMENTS

| | | | |
|---|---|---|---|
| 2534910 | 2/1976 | Fed. Rep. of Germany | 37/142 R |
| 1096146 | 12/1967 | United Kingdom | 299/92 |

*Primary Examiner*—Ernest R. Purser

*Attorney, Agent, or Firm*—R. J. Falkowski

[57] ABSTRACT

A cutter bit assembly having an elongated cutter bit and a bit holder engaged with a bit block. The bit holder and the bit block have an elongated opening for receiving the elongated cutter bit.

12 Claims, 4 Drawing Figures

CUTTER BIT ASSEMBLY

CROSS REFERENCES TO RELATED APPLICATIONS

This invention relates to co-pending application Ser. No. 176,987 entitled "A Cutter Bit Assembly With a Conical Bit Holder" by W. M. Goyarts filed concurrently with this application and herein incorporated by reference.

BACKGROUND OF THE INVENTION

1. Field of the Invention

This invention pertains to a cutter bit assembly and more particularly to a cutter bit assembly wherein an elongated cutter bit and a bit holder are removably attached to a bit block.

2. Description of the Prior Art

In mining, digging and earth working operations, a cutting element is attached to a drive assembly wherein the drive assembly rotates or otherwise moves the cutting element. The cutting element contacts the surface to be worked dislodging material from the surface. As the cutting elements continue to contact the surface they tend to wear and break resulting in loss of efficiency of the mining, digging or earth working apparatus. The cutting element which is either broken or worn must be replaced. It is desired to have a cutting assembly wherein only the broken part must be replaced rather than a complete assembly. Furthermore, it is desired that the replacement be economically and easily done so that the replacement operation can be done on site rather than removing the mining equipment to a garage for a more extensive alteration. It is also desired that the replacable assembly be compact.

Various patents have been directed towards cutter bit assemblies. These patents include U.S. Pat. No. Re. 28,310; U.S. Pat. Nos. 3,158,403; 3,666,321; 3,992,061; 4,057,294; 4,068,897.

SUMMARY OF THE INVENTION

This invention pertains to a cutter bit assembly having an elongated cutter bit and a bit holder with an elongated opening for receiving the cutter bit. The bit holder has an engaging body proportion for engaging a bit block. The bit block also has an elongated means for receiving the elongated cutter bit. A means is provided for removably affixing the elongated cutter bit to the cutter bit assembly wherein the elongated cutter bit having been received by both the bit holder and the bit block locks the bit holder to the bit block.

BRIEF DESCRIPTIONS OF THE DRAWINGS

DESCRIPTION OF THE PREFERRED EMBODIMENTS

Figure 1:
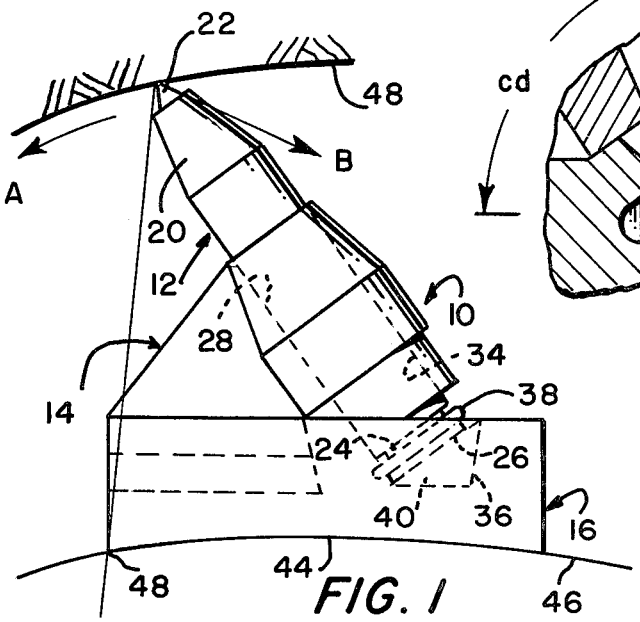
FIG. 1 is a side view illustration of the cutter bit assembly.
Figure 2:
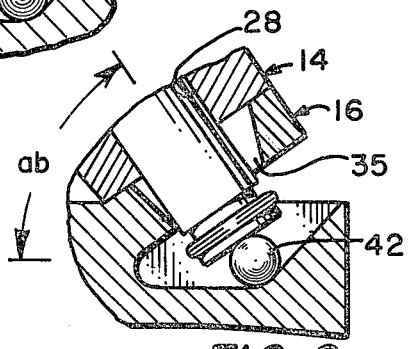
FIG. 2 is a side view illustration of the cutter bit assembly showing an optional insert.

In FIGS. 1 and 2, a cutter bit assembly 10 is shown. Cutter bit assembly 10 comprises an elongated cutter bit 12, a bit holder 14 and a bit block 16. Elongated cutter bit 12 includes conventional cutter bits such as those comprising a cylindrical shaft 18, a conical portion 20 at one end with a cutting tip 22 position atop conical portion 20 and an annular notch 24 and an abutment 26 at the opposite end.

Figure 4:
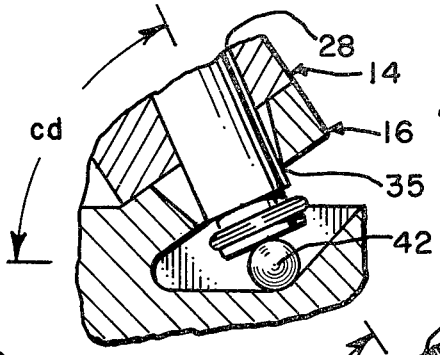
FIG. 4 is a side view illustration of the cutter bit assembly showing an optional insert.
Figure 3:
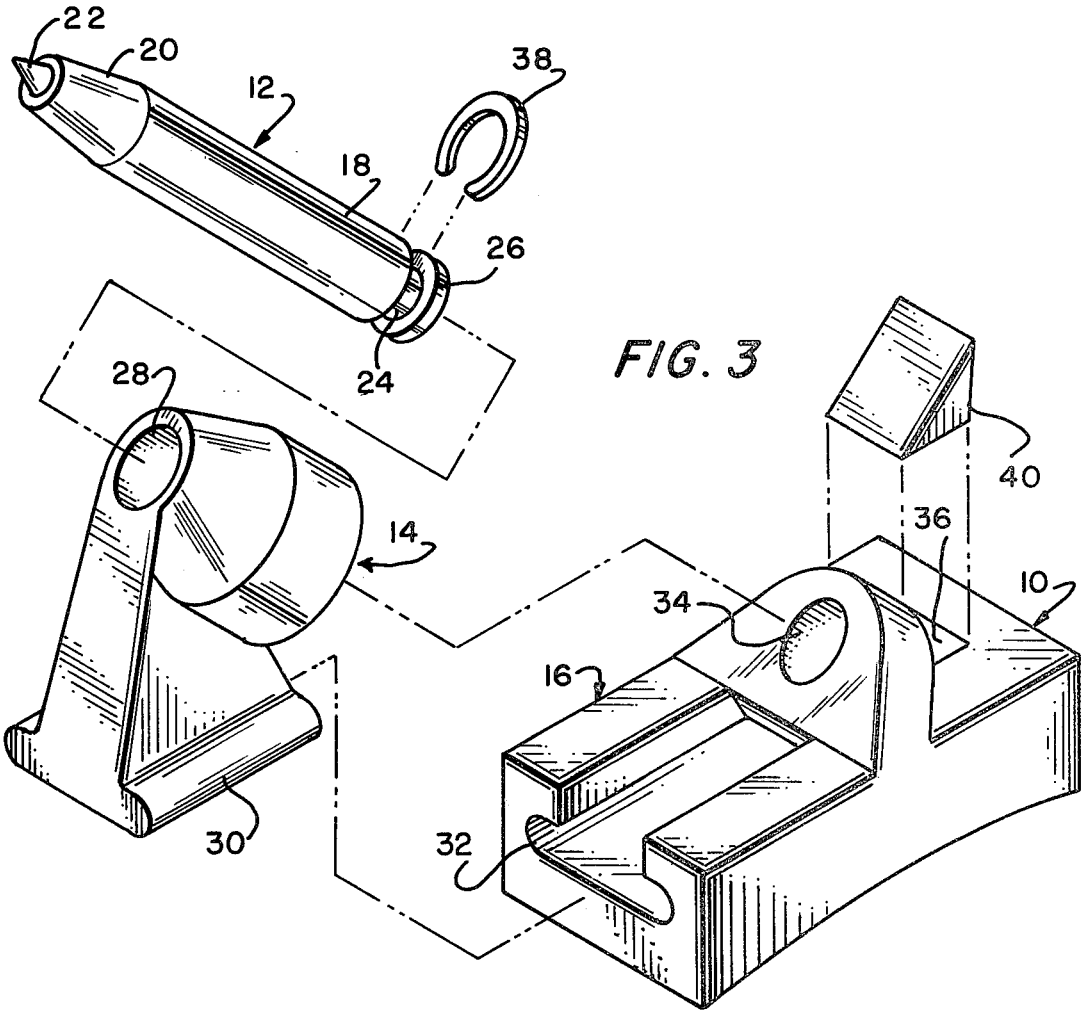
FIG. 3 is an exploded view of the elements of a cutter bit assembly.

Bit holder 14 comprises a first elongated opening for receiving elongated cutter bit 12 and a body engaging portion for engaging bit block 16. The first elongated opening includes conventional openings such as cylindrical openings 28 and is preferably large enough to allow rotation of elongated cutter bit 12. The body engaging portion includes conventional body engaging portions such as bifurcation 30. Bit block 16 has a body engaging means for receiving the body engaging portion of bit holder 14 and a second elongated opening for receiving elongated cutter bit 12. Body engaging means includes the conventional engaging means such as a slot 32 and bifurcations. The body engaging means of bit block 16 cooperates with the body engaging portion of the bit holder 14. In one embodiment of the invention, the body engaging means is in the forward section of bit block 16 as shown in FIGS. 1 and 3. The second elongated opening includes conventional elongated openings such as a cylindrical opening 34 as shown in FIGS. 1 and 3 and conical opening 35 as shown in FIGS. 2 and 4. Bit Block 16 additionally has an abutment 36 for contacting abutment 26 of elongated cutter bit 12. A means is provided for removably affixing elongated cutter bit 12 to cutter bit assembly 10. The means for removably affixing elongated cutter bit 12 to cutter bit assembly 10 includes conventional means such as retaining ring 38, pins and clips.

An insert between abutment 26 and abutment 36 may also be provided. The insert includes conventional inserts such as triangular shaped insert 40 shown in FIGS. 1 and 3, cylindrical inserts 42 shown in FIGS. 2 and 4, rectangular shaped inserts and round shaped inserts. When cylindrical insert 42 is employed, the length of cylindrical insert 42 will preferrably approxiamate the diameter of elongated cutter bit 12. The insert is easily removable with the replacement of the elongated cutter bit or the bit holder. The insert protects the bit block from impact and when an insert is employed the attack angle of the cutter bit may be easily altered as shown in FIGS. 2 and 4. An angle of attack ab is depicted in FIG. 2. The attack angle is altered by replacing bit holder 14 with a bit holder having opening 28 positioned to provide attack angle cd as shown in FIG. 4. With this embodiment the second opening is preferrably a conical opening 35 allowing for the change of attack angle without replacement of bit block 16. Conical opening 35 at one end tapers to the approximate diameter of cutter bit 12 providing for a locking fit but is wider at the other end to allow for attack angle changes. Cylindrical insert 42 also accomodates the change of attack angle without replacement. Thus the attack angle may be changed only by changing bit holder 14.

Bit block 16 is permanently or semi-permanently attached to a drive element by conventional means such as bolting or welding surface 44 to the drive element. The drive element includes conventional drive elements such as rotating drum 46 and chain links.

According to the embodiment of the invention shown in the Figures, cutting tip 22 contacts surface 48 dislodging material therefrom as drum 46 rotates. Afer a period of use various elements of cutter bit assembly 10 wear and break requiring replacement. To replace a broken part retaining ring 38 is removed and elongated cutter bit 12 pulled from cylindrical openings 28 and 34. Elongated cutter bit 12 is replaced if broken or worn. In the event bit holder 14 or insert 40 is damaged they also can be easily replaced. To reassemble the unit then, bit holder 14 is inserted into bit block 16 with bifurcation 30 contacting slot 32. Insert 40, if employed and requires replacement, is positioned into place. Elongated cutter bit 12 is inserted into openings 28 and 34. Since elongated cutter bit 12 is inserted through both bit holder 14 and bit block 16, bit holder 14 is locked to bit block 16. Retaining ring 38 is fastened around annular notch 24 locking the cutter bit assembly 10 together. Furthermore, as cutter bit assembly 10 rotates in direction A as shown in FIG. 1, the resultant force B provides additional locking action to cutter bit assembly 10. As bit assembly 10 operates bit holder 14 and bit block 16 provide a long contact area for elongated cutter bit 12 thus reducing the unconstrained bending stress on elongated cutter bit 12. This reduces the tendency of elongated cutter bit 12 to break. This system may also be designed such that a radian to cutting tip 22 is tangent to an edge 48 of bit block 16. This simplifies the process of attaching cutter bit assembly 10 to drum 46, since cutting tip 22 is readily aligned with the alignment of edge 48.

I claim:

1. A cutter bit assembly comprising:

a. an elongated cutter bit;

b. a bit holder having an engaging body portion wherein the engaging body portion is a bifurcation and a first elongated opening for receiving the elongated cutter bit;

c. a bit block having an engaging means for receiving the engaging body portion of the bit holder and a second elongated opening for receiving the elongated cutter bit; and d. means for removably affixing the elongated cutter bit to the cutter bit assembly wherein the elongated cutter bit having been received by the bit holder and the bit block locks the bit holder to the bit block.

2. A cutter bit assembly according to claim 1 wherein the elongated cutter bit further comprises a cutting tip, a conical portion, a cylinderical shaft, an annular ring and an abutment.

3. A cutter bit assembly according to claim 1 wherein the first elongated opening is a cylinderical opening.

4. A claim according to claim 1 wherein the second elongated opening is a cylinderical opening.

5. A cutter bit assembly according to claim 1 wherein the engaging means for receiving the engaging body portion of the bit holder of the bit block is positioned in the forward section of the bit block.

6. A cutter bit assembly according to claim 1 wherein the means for removably affixing the elongated cutter bit to the bit block is a retaining ring.

7. A cutter bit assembly according to claim 1 wherein the bit block further comprises an abutment.

8. A cutter bit assembly according to claim 1 wherein the cutter bit assembly further comprises an insert positioned between the elongated cutter bit and the bit block.

9. A cutter bit assembly according to claim 8 wherein the insert is a triangular shaped wedge.

10. A cutter bit assembly according to claim 8 wherein the insert is a cylindrical rod.

11. A cutter bit assembly according to claim 10 wherein the length of the cylindrical rod approximates the diameter of the elongated cutter bit.

12. A cutter bit assembly according to claim 1 wherein the second elongated opening is a conical opening.

* * * * *